US006560984B2

(12) United States Patent
Bellet

(10) Patent No.: US 6,560,984 B2
(45) Date of Patent: May 13, 2003

(54) COMPRESSOR FOR A SYSTEM FOR AIR-CONDITIONING THE PASSENGER COMPARTMENT OF A MOTOR VEHICLE

(75) Inventor: Augustin Bellet, Dourdan (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/988,371

(22) Filed: Nov. 19, 2001

(65) Prior Publication Data

US 2002/0062655 A1 May 30, 2002

(30) Foreign Application Priority Data

Nov. 24, 2000 (FR) ..... 0015217

(51) Int. Cl.[7] ..... F25D 23/12; F25B 31/00
(52) U.S. Cl. ..... 62/259.2; 62/505
(58) Field of Search ..... 62/259.2, 505; 361/688, 698, 690; 417/366; 418/83; 172/151

(56) References Cited

U.S. PATENT DOCUMENTS 5,350,039 A * 9/1994 Voss et al. ..... 184/6.16
5,904,471 A 5/1999 Woollenweber et al.
6,041,609 A 3/2000 Hornsleth et al.
6,112,535 A * 9/2000 Hollenbeck ..... 62/228.4
6,321,563 B1 * 11/2001 Ikeda et al. ..... 62/505
2002/0073729 A1 * 6/2002 Shibuya ..... 62/505

FOREIGN PATENT DOCUMENTS

DE 100 17 091 A 1 10/2000

* cited by examiner

*Primary Examiner*—Denise L. Esquivel
*Assistant Examiner*—Marc Norman
(74) *Attorney, Agent, or Firm*—Liniak, Berenato & White

(57) ABSTRACT

A compressor for a system for air-conditioning the passenger compartment of a motor vehicle comprises a casing enclosing a system for compressing a refrigerant fluid, an electric motor for driving the compression system and electronic means for control of the electric motor. A low-pressure intake chamber (24) for the refrigerant fluid is integrated into the casing (6) and is separated from the high-pressure chamber by a separating partition (26). The electronic means for control of the electric motor (12), which are placed in the intake chamber (24), are cooled by the refrigerant fluid. A separate chamber (34) for connection of the motor (12), defined in the casing (6), communicates with the high-pressure chamber (15) via a passage (36). The chambers (24) and (34) are closed off by a cover plate (20) equipped with all the connecting terminals of the compressor.

9 Claims, 3 Drawing Sheets

COMPRESSOR FOR A SYSTEM FOR AIR-CONDITIONING THE PASSENGER COMPARTMENT OF A MOTOR VEHICLE

FIELD OF THE INVENTION

The invention relates to the cooling of the electrical and/or electronic control and monitoring circuits of an air-conditioning system.

BACKGROUND OF THE INVENTION

It relates more particularly to a compressor, especially for a system for air-conditioning the passenger compartment of a motor vehicle, comprising a casing defining a high-pressure chamber enclosing a system for compressing a refrigerant fluid which circulates in the air-conditioning system, this compression system taking in the refrigerant fluid at low pressure and delivering it at high pressure into the high-pressure chamber, an electric motor for driving the compression system and electronic means for control and monitoring of the operation of the electric motor.

The compressors used to compress a refrigerant fluid in a system for air-conditioning the passenger compartment of an electrified motor vehicle are controlled by power electronics circuits. The speed of rotation of the compressor is controlled by an inverter which gives rise to thermal losses during its operation. This is why it is necessary to cool these electronic circuits in order to ensure their operation and to extend their lifetime.

A compressor of the hermetically sealed type is already known (U.S. Pat. No. 6,041,609 DANFOSS) in which the inverter governing the rotational speed of the compressor is housed in a box fixed to the outside of the casing of the compressor, and is cooled by contact and heat exchange with the intake tube before the refrigerant fluid coming from the evaporator enters the compressor.

A compressor of this type exhibits several drawbacks. It is of substantial size because of the presence, on the outside of the compressor, of a box in which the electronic components are housed. It is relatively complex to manufacture and to assemble because it is necessary to provide a modification to the intake line so that it provides the necessary and sufficient surface area for contact and heat exchange.

SUMMARY OF THE INVENTION

The subject of the present invention is precisely a compressor of the type defined in the introduction, which remedies these drawbacks.

This compressor includes a low-pressure intake chamber for the refrigerant fluid integrated in the casing, which is separated from the high-pressure chamber by a separating partition, the electronic means for control and monitoring of the operation of the electric motor, which are placed in the intake chamber, being cooled by the refrigerant fluid.

By virtue of these characteristics, a compressor featuring great compactness is produced. This compressor can easily be mounted into the vehicle, because there is a single component to be fixed, and a single area for connecting the electrical and electronic circuits. The sound level of the pulsation of the gas on the intake line of the compressor, as well as the mechanical noises given off by the compression pump and its valve are reduced by the presence of a buffer volume consisting of the intake chamber.

The cost of manufacture of this compressor is reduced by the integration of the electronic circuits for control of the motor of the compressor in a single casing.

Finally, the losses by Joule effect in the phase wires linking the inverter to the motor are reduced to practically nil as a result of the short length of these connections.

The compressor preferably includes a separate chamber for electrical connection of the motor, defined in the casing, this separate chamber communicating with the high-pressure chamber via a passage.

The intake chamber and the separate chamber for electrical connection of the motor are advantageously presented as cavities which are open towards the outside of the casing and are closed off by a cover plate which is common to the two chambers.

In one preferred embodiment, the cover plate is a terminal plate equipped with all the connecting terminals necessary for the operation of the compressor. The input and output terminals for the power supply to the electric motor and outlet terminals for motor information (for example on the temperature of the motor) are situated in a part of the terminal plate which closes off the separate chamber for connection of the electric motor, and the other connecting terminals are situated in a part of the terminal plate which closes off the intake chamber.

Advantageously, the outlet terminals from the intake chamber and the input terminals of the motor in the separate chamber are fixed, permanent and insulated as from delivery of the terminal plate before it is mounted onto the casing of the compressor.

According to another characteristic of the invention, the electronic means for control and monitoring of the operation of the compressor are arranged on a power module including a metal cooling sole plate.

According to another advantageous characteristic of the invention, the electronic means for control and monitoring of the operation of the compressor are connected to the power module, and these electronic means and the power module, with the exception of the cooling sole plate, are coated in an overmoulding of plastic.

This plastic must be compatible with the refrigerant fluid and the lubricating oil of the compressor. It is preferably chosen from the family of elastomer polyester thermoplastics. It is preferred to use an elastomer polyester plastic known by the commercial trademark HY-TREL G 3548 from the Dupont Company of Nemours.

In one preferred embodiment, the casing is produced as a first part containing the gas-compression system, the intake chamber and the separate electrical-connection chamber, and a second part containing the electric motor, these two parts being assembled to one another along a junction plane.

BRIEF DESCRIPTION OF THE DRAWINGS

Other characteristics and advantages of the invention will emerge further on reading the description which follows of an embodiment example given by way of illustration, by reference to the attached figures. In these figures.

DETAILED DESCRIPTION OF THE PREFERRED EMBODIMENT

Figure 1:
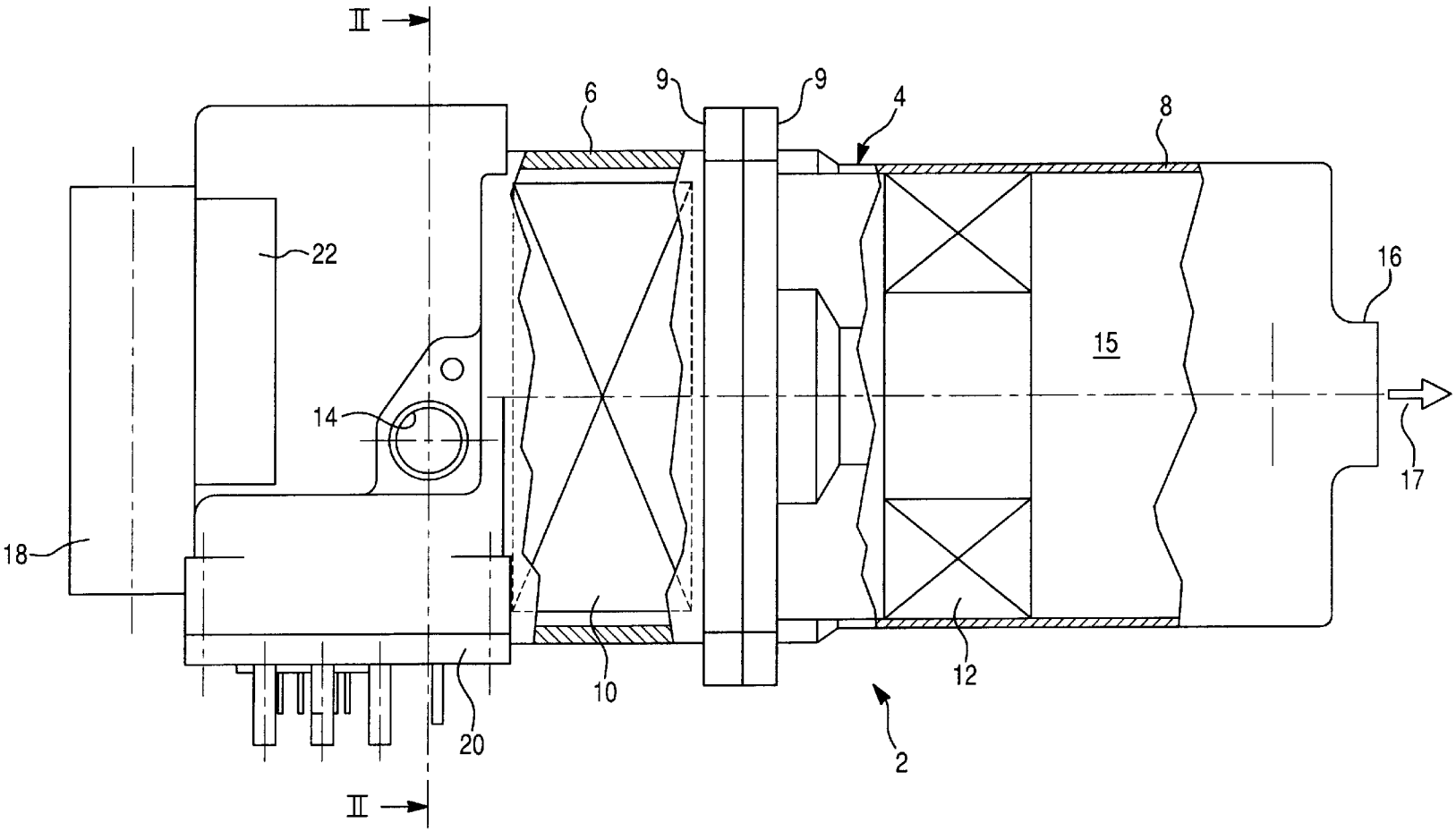
FIG. 1 is a top view, with cutaway, of a compressor in accordance with the present invention.

FIG. 1 represents a top view of a compressor 2 in accordance with the present invention. Such a compressor is intended to form part of a system for air-conditioning the passenger compartment of a motor vehicle which, conventionally, comprises a closed loop for circulation of a refrigerant fluid. The refrigerant fluid, in the gaseous phase, originating from the evaporator (not represented) is taken in at low pressure into the compressor 2 and delivered at high pressure into a condenser (not represented), from which it emerges in liquid phase. After pressure release, the fluid returns to the evaporator in which it takes up heat from the surrounding medium, and the cycle repeats.

In the embodiment example represented, the compressor 2 comprises a casing 4 consisting of a first part 6 and of a second part 8. The casing 4 is preferably produced from moulded aluminium. Each of the parts 6 and 8 includes a flange 9 by which the two parts are assembled to one another along a junction plane, for example by means of screws (not represented).

The system for compressing the refrigerant fluid 10 is located in the part 6. A compressor of the type with spirals, also called "scroll compressor", will preferably be used. It is also possible to use a compressor of the rotating-piston type. The compression system 10 comprises a low-pressure intake chamber into which the gas originating from the evaporator is admitted. It delivers this gas at high pressure into a high-pressure chamber 15 defined within the casing 4. The electric motor 12 driving the compression system 10 is located in the second part 8. The rotational speed of this motor can be governed by varying the frequency of the current and of the voltage which supply it.

The gas originating from the evaporator penetrates into the compressor 2 via an inlet orifice 14 so as to be allowed into an intake chamber which will be described in more detail later. From the intake chamber, the gas is allowed directly into the compression system 10, then delivered into the high-pressure chamber 15 which it traverses while cooling the electric motor 12. The gas leaves the high-pressure chamber 15 through an outlet orifice 16 as shown diagrammatically by the arrow 17. It is then led to the condenser (not represented).

The presence of a terminal plate 20 will also be noticed in FIG. 1, this plate 18 being equipped with all connecting terminals necessary for the operation of the compressor, as well as the presence of electrolytic capacitors 18 and of power relays 22, situated close to the terminal plate 20.

Figure 2:
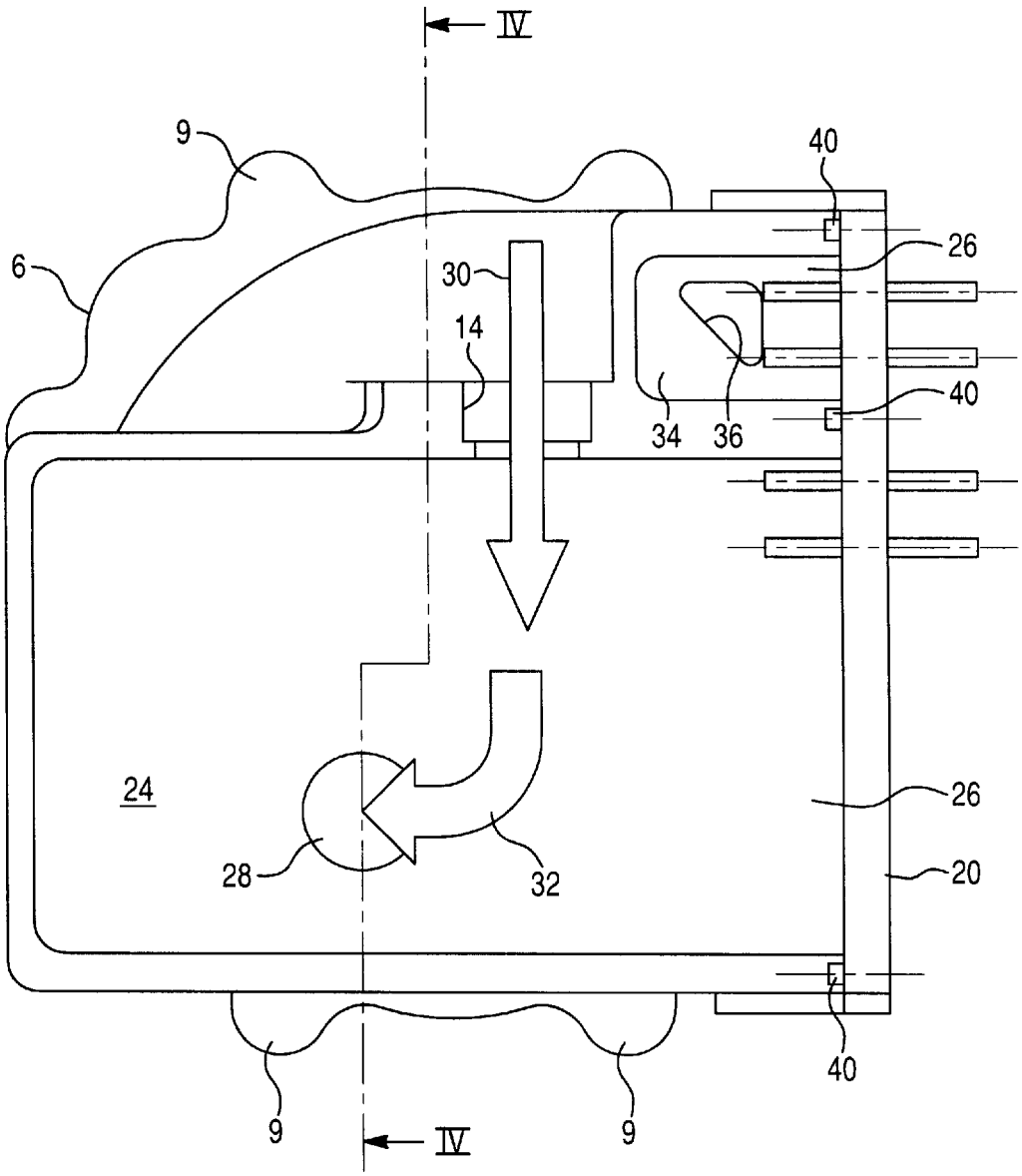
FIG. 2 is a view in section along the line II—II of the compressor represented in FIG. 1.

As can be seen in FIG. 2, the intake chamber 24 is presented as a cavity which is open towards the outside of the part 6 of the casing. It is separated from the high-pressure chamber 15 by a separating partition 26. A communicating orifice 28 is provided in the partition 26. This orifice allows the gas to enter into the compression system 10. The gas originating from the evaporator penetrates through the intake orifice 14, as shown diagrammatically by the arrow 30, passes through the low-pressure intake chamber 24, then emerges through the communicating orifice 28 as shown diagrammatically by the arrow 32.

A second chamber 34, smaller than the chamber 24, and itself also being presented as a cavity which is open towards the outside of the part 6 of the casing, is formed in order to allow the electrical connection of the motor. A passage 36 passing through the casing 4 puts the chamber 34 in direct communication with the motor situated in the high-pressure chamber 15. This passage runs along the side of the part 6 of the casing 4 of the motor 12 so as to open out behind the compression system in the part 8 of this casing.

The chambers 24 and 34 are closed by a common plate which at the same time constitutes the terminal plate 20. A sealing gasket 40 is provided in order to ensure leaktightness between the intake chambers 24 and 34 in order to ensure the leaktightness of each of these chambers with the outside.

Figure 3:
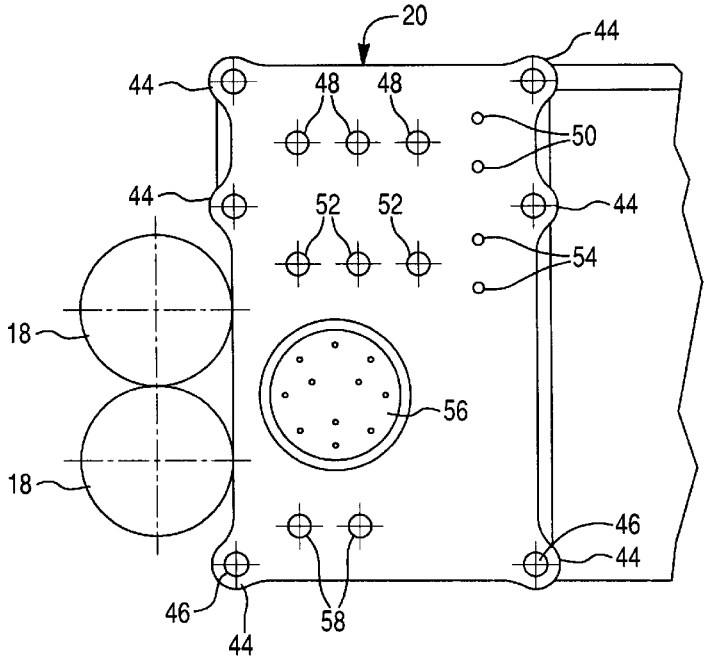
FIG. 3 is a partial view in elevation of the compressor represented in FIG. 1.

The terminal plate 20 has been represented in front view in FIG. 3. It includes six lugs 44 allowing it to be fixed by screws 46 onto the first part 6 of the casing 4 of the compressor, thus compressing the sealing gasket 40. The terminal plate groups together all the connecting terminals necessary for the operation of the compressor. At its upper part are found three input terminals 48 for the three-phase lines which set out to supply the motor 12, as well as two terminals 50 for output of information from the motor (for example: the temperature of this motor). The three connecting terminals 48, as well as the two connecting terminals 50, are situated facing the small, separate chamber 34 and the communication passage 36 perforated in the wall 26 lets through the electrical cables which link these terminals to the motor.

At the lower part of the terminal plate 20 are found the outlet terminals 52 for the power-supply phases of the electric motor 12, two terminals 54 for return of information, a multi-pin terminal 56 for the functions of communication with the module for temperature regulation of the passenger compartment, the outputs of various protection devices managed by the microcontroller, the control of the relays serving to charge the input capacitors. Finally, two positive and negative DC power-supply terminals 58 are found. All these connecting terminals are situated facing the intake chamber 24.

The output terminals 50 and 52 from the intake chamber 24 and the input terminals 48 and 54 of the motor in the separate chamber 34 are fixed, permanent and insulated as from delivery of the terminal plate 20 before it is mounted onto the casing 4 of the compressor.

For reasons of reliability, permanent insulated connecting bars will be provided, linking the three motor phases 48 and 52 on the outside of the chambers 24 and 34 as well as the returns of motor information 50 and 54.

Figure 4:
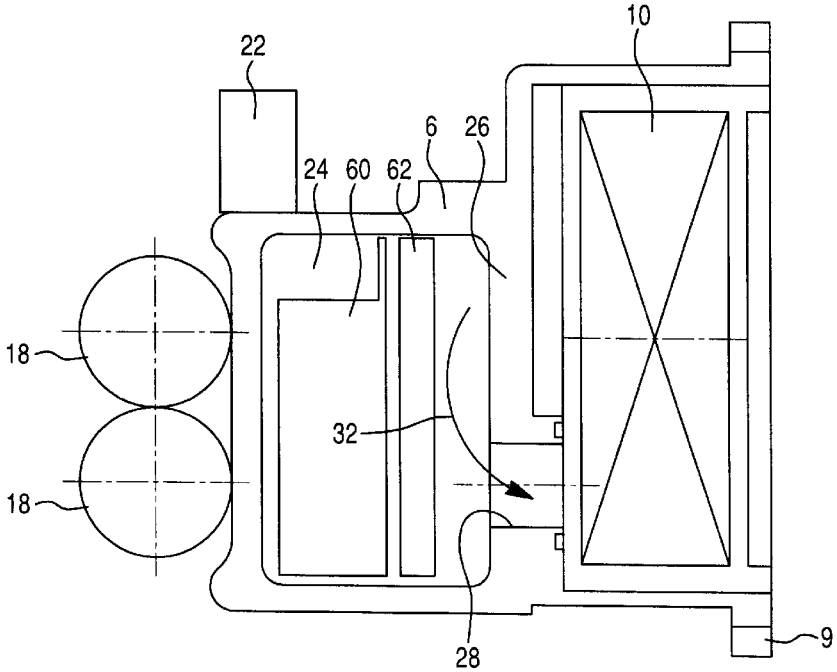
FIG. 4 is a view in section along the line IV—IV of FIG. 2 of a part of the casing of the compressor of the invention.

In FIG. 4 has been represented a view in longitudinal section, along the section line IV—IV of FIG. 2, of the first part 6 of the casing 4 of the compressor. The electronic circuits 60 for monitoring and control of the compressor are housed in the intake chamber 24.

These circuits 60 are based on a power module 62 featuring a metal cooling sole plate. They comprise electronic power components (MOSFET or IGBT) which are encapsulated in the power module 62. Furthermore, the control electronics are mounted on a printed circuit, which is soldered to the power module.

The electronic circuits 60 and the power module 62, with the exception of the cooling sole plate, are coated in an overmoulding of a plastic which is compatible with the lubricating oil—generally an oil of the POE (polyol ester) type—of the compressor circulating in the refrigerant fluid and with the refrigerant fluid itself.

This plastic is preferably chosen from the family of elastomer polyester thermoplastics. It is preferred to use an elastomer polyester thermoplastic known by the commercial trademark HYTREL G 3548 from the Dupont Company of Nemours.

The refrigerant fluid, let into the chamber 24 through the intake orifice 14 (see FIG. 2), passes vertically through the low-pressure chamber 24, lapping over the metal sole plate of the power module 62 before re-emerging through the communication orifice 28.

Thus the cooling of the electronic power circuit is ensured without having recourse to a supplementary air or water circuit. The losses from the power module are reduced because it is better cooled. Likewise, its reliability and its lifetime are augmented by reducing its operating temperature. Thus effective cooling of the power electronics of the compressor is achieved without impairing its compactness, and at a reduced manufacturing cost.

What is claimed is:

1. A compressor for air-conditioning a passenger compartment of a motor vehicle, comprising:

a casing (4) defining a high-pressure chamber (15) enclosing a system (10) for compressing a refrigerant fluid which circulates in the air-conditioning system, said system (10) taking in the refrigerant fluid at low pressure and delivering said refrigerant fluid at high pressure into the high-pressure chamber (15);

an electronic means (60) for controlling and monitoring operation of an electric motor (12); and an intake chamber (24) containing said refrigerant fluid at low pressure, wherein said intake chamber is integrated into the casing (4) and is separated from said high-pressure chamber (15) via a separating partition (26), wherein the electronic means (60) for controlling and monitoring operation of the electric motor (12) are disposed within the intake chamber (24) and cooled by the refrigerant fluid, wherein the casing (4) is produced as a first part (6) and a second part, said first part further comprising the system (10) for compressing said refrigerant fluid, said intake chamber (24), and a separate chamber (34), and said second part (8) comprising the electric motor (12), wherein said first and said second parts are assembled along a junction plane.

2. The compressor according to claim 1, wherein the separate chamber (34) houses an electrical connection of the electric motor (12), and communicates with the high-pressure chamber (15) via a passage (36).

3. The compressor according to claim 2, wherein the intake chamber (24) and the separate chamber (34) for electrical connection of the electric motor (12) are cavities which are open towards the outside of the casing (4) and are closed off by a single cover plate (20).

4. The compressor according to claim 3, wherein the cover plate is a terminal plate (20) equipped with all the connecting terminals necessary for operation of the compressor.

5. The compressor according to claim 4, further comprising input terminals (48) for the power supply to the electric motor (12) and outlet terminals (50) for motor information, wherein said input terminals are disposed on a first part of the terminal plate which closes off the separate chamber (34) for connection of the electric motor, and said outlet terminals are disposed on a second part of the terminal plate which closes off the intake chamber (24).

6. The compressor according to claim 5, wherein the outlet terminals (50, 52) from the intake chamber (24) and the input terminals (48, 54) of the motor in the separate chamber (34) are permanently fixed and insulated to the terminal plate (20) before said terminal plate is mounted onto the casing (4) of the compressor.

7. The compressor according to claim 5, wherein the electronic means (60) for control and monitoring operation of the electric motor (12) are arranged on a power module (62) including a metal cooling sole plate.

8. The compressor according to claim 7, wherein the electronic means (60) for control and monitoring operation of the electric motor are connected to the power module (62), wherein the electronic means (60) and the power module (62) are coated in an overmoulding of plastic.

9. The compressor according to claim 8, wherein the plastic is compatible with the refrigerant fluid and a lubricating oil of the compressor, said plastic is chosen from the family of elastomer polyester thermoplastics.

* * * * *